United States Patent [19]

Venot

[11] 3,942,312

[45] Mar. 9, 1976

[54] MACHINE FOR TREATING A TEXTILE THREAD BY FALSE TWIST

[75] Inventor: Jean Venot, Villerest, France

[73] Assignee: Chavanoz S.A., Chavanoz, France

[22] Filed: Feb. 3, 1975

[21] Appl. No.: 546,571

Related U.S. Application Data

[63] Continuation of Ser. No. 464,211, April 25, 1974, abandoned.

[30] Foreign Application Priority Data

Oct. 19, 1973 France ..... 73.37988

[52] U.S. Cl. ..... 57/34 HS; 57/106

[51] Int. Cl.[2] ..... D01H 13/04; D01H 13/28

[58] Field of Search..... 57/34 R, 34 HS, 34.5, 56, 57/157 R, 157 MS, 157 TS, 106; 28/62

[56] References Cited

UNITED STATES PATENTS

| | | | |
|---|---|---|---|
| 2,891,375 | 6/1959 | Vandamme et al. | 57/34 HS |
| 3,051,364 | 8/1962 | Barnes et al. | 57/34.5 X |
| 3,066,471 | 12/1962 | Seragg | 57/34.5 |
| 3,165,881 | 1/1965 | Moncuitt et al. | 57/34 HS |
| 3,241,234 | 3/1966 | Kiefer et al. | 57/34.5 X |
| 3,501,904 | 3/1970 | Batsch | 57/34.5 |
| 3,609,951 | 10/1971 | Hunter | 57/34 HS |
| 3,633,353 | 1/1972 | Wurmli | 57/34 HS X |
| 3,638,411 | 2/1972 | Tsugawa et al. | 57/34 HS |
| 3,793,817 | 2/1974 | Beringer | 57/34 HS |

FOREIGN PATENTS OR APPLICATIONS

| | | |
|---|---|---|
| 1,391,179 | 1/1965 | France |
| 1,206,826 | 8/1959 | France |
| 2,004,284 | 11/1969 | France |

OTHER PUBLICATIONS

Textured Yarn Technology, Vol. 2, "Stretch Yarn Machines" Monsanto Co., 1967.

Textured Yarn Technology Supplement '68, Monsanto Co. 1968.

*Primary Examiner*—Donald E. Watkins

*Attorney, Agent, or Firm*—Luke J. Wilburn, Jr.; H. William Petry

[57] ABSTRACT

A textile false twist texturing machine having improved thread-up comprising for each thread working position means for removing fumes given off in the heaters and means for threading up and guiding the thread in the upper part of the machine, and wherein the means for threading up and guiding the thread extends continuously from the outlet of the first thread delivery means to the entry of the first heater, and is coupled at the entry into the first heater with the fume removal means.

6 Claims, 2 Drawing Figures

MACHINE FOR TREATING A TEXTILE THREAD BY FALSE TWIST

This is a continuation of application Ser. No. 464,211, filed Apr. 25, 1974 now abandoned.

The present invention relates to a machine for treating a textile thread, and in particular a machine having improved means for transfer of the thread from a thread supply station to a thread receiving or take-up station. It relates more particularly to means for transferring a thread on a machine, which has considerable size, especially in height, such as a machine for texturing a thread by fixed false twist. Such a fixed false twist machine contains, in particular, two thread heating components, commonly known as heaters, disposed in series in the thread path and in general alignment with each other.

In one embodiment of such a machine, in order, in particular, to reduce the machine height, the machine is provided with two separate frames spaced from one another in facing relation, one of the frames comprising support means for the thread supply bobbins and the thread take-up components, and the other frame comprising the thread treating components, i.e., heaters, spindles, as well as the thread advancing or delivery means. The two frames of the machine are joined essentially at their base by a platform on which the operator can walk to service the frames. Such a machine is described in U.S. Pat. No. 3,165,881.

In a recent machine embodiment, the thread supply supports are placed above the thread receiving or take-up components and face the first heater, a raised catwalk linking the two opposing faces or sides of the machine, with the distance between the lower operator platform and the raised upper catwalk being greater than the average height of the human operator. According to this type of machine, the other thread treatment components, i.e., thread delivery means, spindles and second heater, are placed below the catwalk, and hence are easily accessible to the operator who normally moves between the two sides of the machine on the lower platform.

This particular arrangement of the various components of the machine has been made necessary by the fact of the increase in treatment speeds which entailed an extension in length of the heaters in order to retain a sufficient heating time for the thread.

In U.S. Pat. application Ser. No. 459,7ll, filed Apr. 10, 1974 now abandoned, there has been described a solution to the problem of handling a thread during thread-up of a texturing machine of the fixed false twist type in which the thread supply and the first heater are placed in the bottom part of the machine and the second heater and the thread take-up are placed in the top part of the machine. In the embodiment described in said application, use is made of pneumatic means of transport to facilitate the thread-up of the machine, the pneumatic means extending substantially from the output of the second thread advancing means to the thread take-up station. Such pneumatic conveyor means comprises, in combination,

1. an aspiration-to-waste component capable of aspirating the thread from the second heating component,

2. pneumatic means (blast heads) for transporting thread into and through the heating channel of the second heating component, the third advancing means, and beyond, and

3. a pneumatic conveyor tube having a mouthpiece situated in proximity to and below the third thread advancing means, and an outlet located in the vicinity of the thread take-up or receiving station.

Although the thread conveying system described above is satisfactory for the handling of the thread in fixed false twist texturing machines in which the thread treatment components are positioned on the same side with the first heater located in the lower part of the machine, it is not adapted to machines in which the thread supply stations and the first heaters are placed face to face in the upper part of the machine. Furthermore, it is necessary to recognize that the solution in U.S. Pat. application Ser. No. 459,711, filed Apr. 10, 1974 has certain drawbacks in spite of its effectiveness. The installation requires a large amount of conveying fluid during the thread-up because of passage of the thread in the open air between the second heater and the input of the pneumatic conveyor tube leading to the thread take-up station. Moreover, the device is rather complex since it requires a blast head device at the input to the second heater. Finally, it is well known that synthetic threads are oiled at the time of spinning, and that, while the thread is being heated in a false twist machine, the textile oils are generally transformed into fumes and recondense in the form of oil. Consequently, fixed false twist machines must contain components which eliminate these fumes. French Pat. No. 1,363,920, which corresponds to U.S. Pat. No. 3,283,414, describes a process and a device for recovery of the fumes, the process consisting of aspirating away outside air and fumes at the outlet end of the heating components, and blowing air into the entrance of the heating components in the direction of movement of the thread.

The present invention provides a solution to the problems reviewed above and facilitates thread-up of a false twist machine as well as effectively eliminates the fumes and oils which can form in the heaters during the treatment. The invention relates to a machine for the treatment of a thread by false twist which contains two spaced frames positioned in facing relation, one of the frames containing the thread supply bobbins and the thread collection components for the treated thread, and the other frame supporting the heaters and spindles for treatment of the thread. The thread supply bobbins and the first heaters are placed in the upper part of the machine. Each thread working position contains means for eliminating the fumes given off by the thread in the heaters, as well as means for transporting and guiding of the thread in the top part of the machine, characterized in that, for each position, the first textured thread delivery or advancing means is placed on the same side as the thread treatment components within the reach of the operator, the thread transporting and guidance means extending continuously from the outlet from the first delivery means to the entry of the first heating component.

According to a preferred form of embodiment, the thread transporting and guidance means in the upper part of the machine appear in the form of a duct connected on a level with the entry into the first heating component with the means of fume evacuation. The connection of the various components at the entry to the first heat treatment component is accomplished, in one form of embodiment, by means of a junction member, or duct, in the form of a T, whereby the duct is joined to the entry to the heater, one of the arms being curved at the end and joined to the end of the guidance and transporting duct and the other arm being joined to the end of the fume elimination blast duct. Furthermore, in order to facilitate the passage of the thread inside the junction member, guides, preferably of ceramic, are placed in the zones where the thread undergoes a change in direction. And finally, the junction member contains an internal fluid distribution chamber in order that the fluid coming from the fume elimination blast member will be directed in the direction of the moving thread.

The passage of the thread through the various components of the machine during thread-up is advantageously done by means of a pneumatic aspiration gun. For this, according to the invention, it is arranged that the outlet from the first heater, and optionally from the second heater, has a form adaptable to the aspiration head of the thread manipulation air gun. The length of the gun is such that the operator may attend the outlet from each heater while remaining on the lower platform.

The invention will be better understood with the aid of the example to follow and the drawings, given by way of illustration, but non-limiting.

Figure 1:
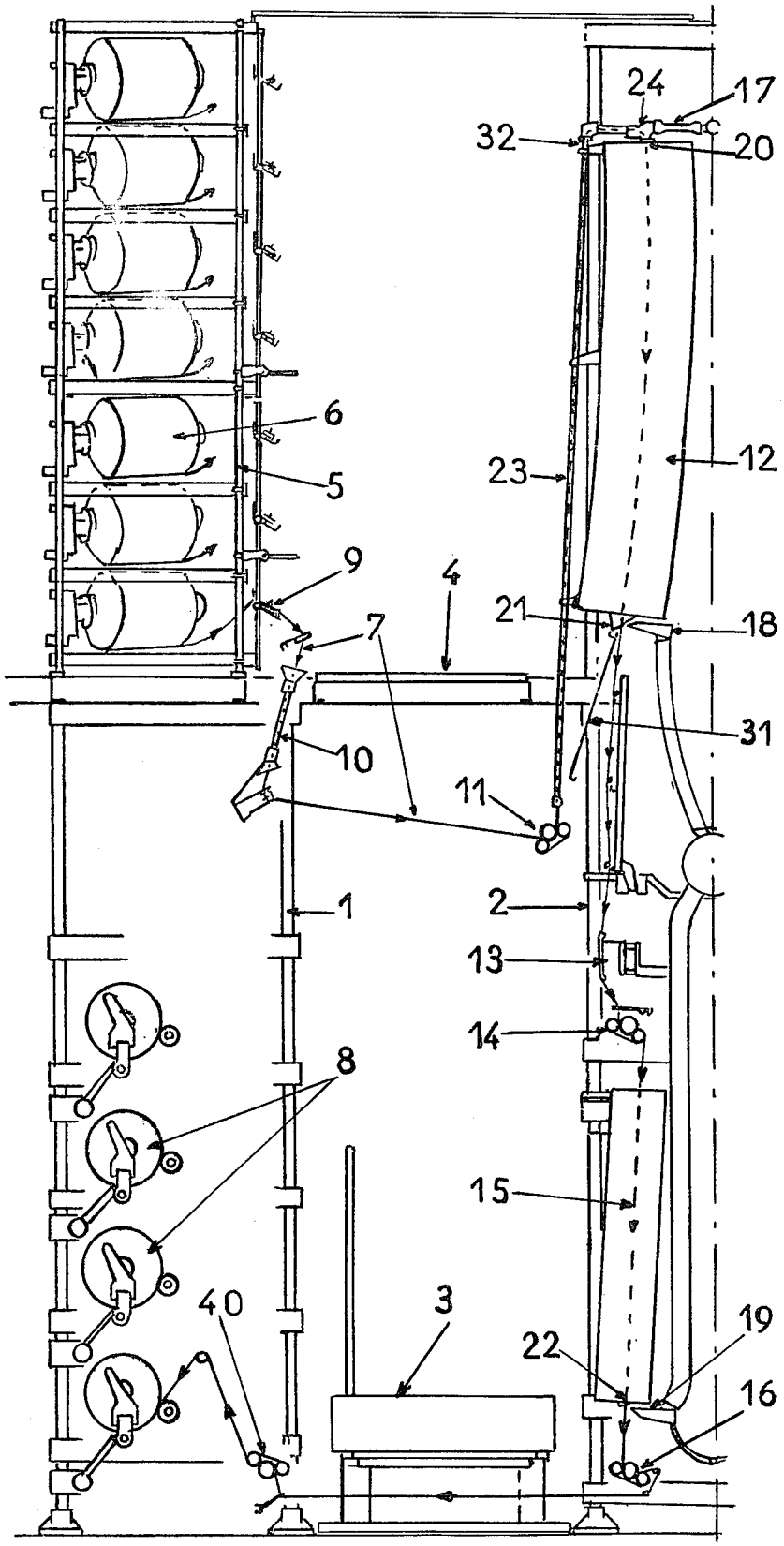
FIG. 1 represents, diagrammatically, an end view of a fixed false twist machine according to the invention.

The fixed false twist machine represented in FIG. 1 is an end elevation view of the type machine containing two spaced frames 1, 2 connected at the bottom by a platform 3, and in the middle by a catwalk 4, on which the operator can move. The drawing shows only the components comprising a single thread working position of the machine, but it is to be understood that the machine is composed of a plurality of such positions extending in side by side relation along the length of platform 3.

Frame 1 has at the top supports 5 for bobbins 6 supplying thread 7, and at the bottom the components receiving the treated thread and optionally a thread delivery means 40. It also supports thread guides and tensioners 9 as well as guidance members 10 which conduct the threads from the upper part of the machine to beneath the catwalk 4.

Frame 2 carries, for each treatment position, a first thread delivery means shown as a driven roller and belt 11 which advance the thread positioned below catwalk 4, a first heating member 12 of the curved tubular heater type positioned in the upper part of the machine, a false twist spindle 13 spaced from the first heater 12 to provide a path in the open air for the thread as it leaves the heater, a second thread delivery means 14, a second heater 15, and a third thread delivery means 16. As mentioned, each thread delivery means is illustrated as a cooperating roller and endless belt arrangement which are suitably driven and grippingly engage the thread to advance the same along the yarn path, although other means might be employed, if desired.

According to the invention, the machine contains means of elimination of the fumes given off in the heaters, as well as thread transporting and guiding means in the upper part of the machine. The fume elimination means is embodied according to the embodiment described in French Pat. No. 1,363,920, and U.S. Pat. No. 3,283,414 and comprises, essentially, a blast duct 17 connected to the entry 20 of the first heater 12, and aspiration or suction heads 18, 19 placed, respectively, in proximity to the outlets 21, 22 from the two heaters 12 and 13.

The thread transporting and guidance means in the upper part of the machine is comprised of a guide tube 23 extending continuously from the outlet of the first thread delivery means 11 to the entry 20 of the first heater 12. According to a preferred embodiment of the invention, the connections of the blast duct 17 and the guide tube 23 to the entry 20 of the first heater are made by means of a common junction member 24 having three openings. This method of connection is illustrated in FIG. 2.

Figure 2:
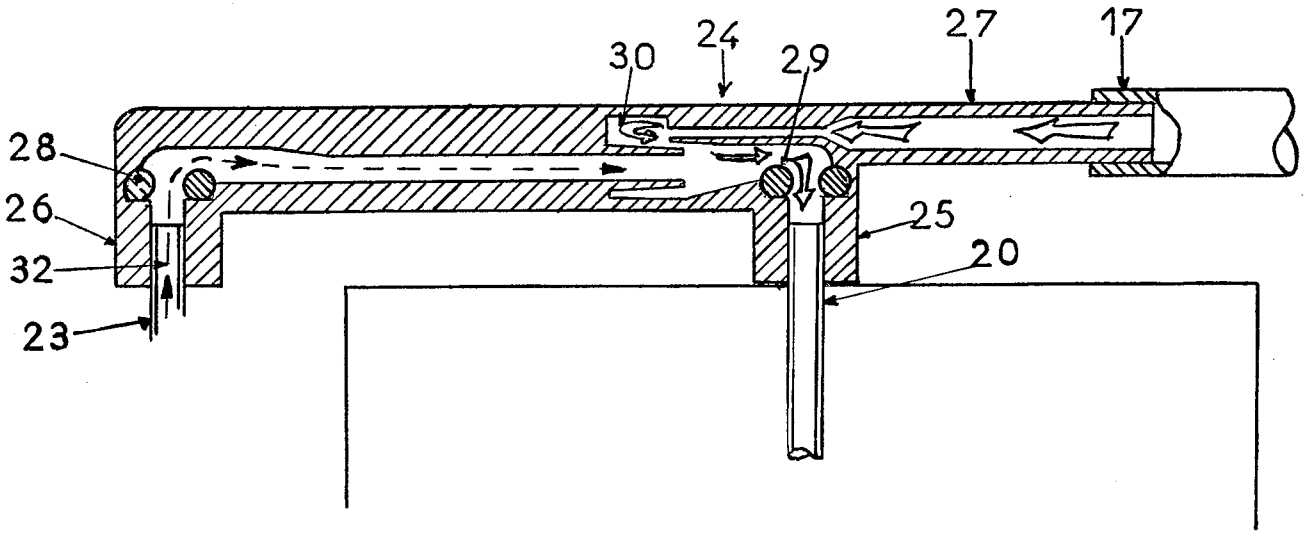
FIG. 2 is a sectional view of the member connecting the thread delivery and transporting duct, respectively, with the upper end of the first heater and with the end of the fume evacuation blast duct.

As can best be seen in FIG. 2, the entry 20 to the first heater is connected both to the end of the continuous straight transporting and guidance duct 23 and to the end of the fume removal blast duct 17 by means of a junction member 24 having three openings 25, 26, 27. This junction member, in the form illustrated in FIG. 2, comprises the shape of a T, the base 25 of which is connected to the entry to the heater 20. As seen, one of the arms of the T is curved at its end and connected to the end of the continuous, straight guidance duct 23, while the other end 27 of the T is connected to fume elimination blast duct 17. In order to facilitate the passage of thread, guides 28, 29, which are preferably of ceramic, are placed inside the junction member in the zones where the thread undergoes a change in direction. Furthermore, the junction member contains a chamber 30 for distribution of pressurized gas or fluid coming from the blast member 17, the current of fluid being directed in the direction of movement of the thread through the machine.

The thread-up of the thread in the fixed false twist machine according to an example is as follows. Thread 7, supplied from feed bobbins 6, is passed manually through disc tensioner 9 and guide 10. From this moment on, and except when it is necessary to replace the feed bobbins, all the operations of thread-up and work are normally carried on from platform 3 by a single operator, without the operator's having to climb onto catwalk 4. The thread 7, then issuing from guide 10, is passed into the first thread delivery means 11. The end of an aspiration gun is then placed at the outlet 21 from the first heater 12, the end of the gun being guided to some extent to the outlet by a plate 31. The aspiration or suction of the air from the heater tube 12 entrains or pulls the thread into tube 23, junction member 24, and through heater 12. The thread is then passed in conventional fashion through the other components of the machine (spindle 13, thread delivery means 14, heater 15, thread delivery means 16) and finally into the thread take-up system.

The invention, of course, is not limited to the example described, but encompasses variants thereof. The invention may be employed if there is no fume blast head and the guidance and transport tube is connected directly to the entry to the first heater.

That which is claimed is:

1. In a machine for the false twist texturing of textile threads in a plurality of side by side thread treating positions comprising two up-standing spaced support frames positioned in facing relation, an operator walkway at the bottom of and extending between said frames to permit access to said thread treating positions, one of said frames supporting thread supply and thread take-up means and the other of said frames supporting thread heaters and false twist spindles for treating the threads, the thread supply means and the first heater of each thread treating position being located in an upper portion of the frames above the level of the head of an operator, each first heater including an elongate, thread passageway having a inlet at its upper end in the upper portion of the frame and a thread outlet at its lower end adjacent the level of an operator's head, means for removing fumes given off by the heated thread in the heater passageway operatively connected to said thread inlet, and means for transporting and guiding the thread at each thread treating position in a path from said thread supply means through said first heater and to said thread take-up means; the improvement therein comprising a first thread delivery means positioned in said thread path adjacent the head level of an operator within reach of the operator's hands, and wherein said means for transporting and guiding the thread includes means in the upper portion of the machine for pneumatically conveying the thread continuously from the outlet of said first delivery means to the inlet of said first heater.

2. A machine as defined in claim 1 wherein said means for pneumatically conveying the thread includes an elongate thread guide tube extending from the outlet of said first thread delivery means to said heater passageway inlet and is operatively connected to said means for removing the fumes given off by the threads.

3. A machine as defined in claim 2 wherein said fume removal means includes means for introducing a fluid current, and said pneumatic conveying means and said means for removing the fumes includes junction means connected to the inlet of said first heater passageway, said junction means including a generally T-shaped passageway, the base of which is connected to the inlet of the heater passageway and the arms of which are connected to said current introducing means and said guide tube.

4. A machine as defined in claim 3 wherein said junction member includes ceramic guide means in said T-shaped passageway to facilitate changing direction of the thread in its path of travel through said passageway.

5. A machine as defined in claim 3 wherein said junction member includes an internal chamber for directing fluid from said current introducing means in the direction of movement of thread in the thread path of travel through said passageway.

6. In a machine for the false twist texturing of textile threads in a plurality of side by side thread treating positions comprising two up-standing spaced support frames positioned in facing relation, an operator walkway at the bottom of and extending between said frames to permit access to said thread treating positions, one of said frames supporting thread supply and thread take-up means and the other of said frames supporting thread heaters and false twist spindles for treating the threads, the thread supply means and the first heater of each thread treating position being located in an upper portion of the frames above the level of the head of an operator, each first heater including an elongate, thread passageway having a inlet at its upper end in the upper portion of the frame and a thread outlet at its lower end adjacent the level of an operator's head, and means for transporting and guiding the thread at each thread treating position in a path from said thread supply means through said first heater and to said thread take-up means; the improvement therein comprising a first thread delivery means positioned in said thread path adjacent the head level of an operator within reach of the operator's hands, and wherein said means for transporting and guiding the thread includes a thread guide tube extending from adjacent the outlet of said first delivery means to the inlet of said first heater for pneumatically conveying the thread continuously from the outlet of said first delivery means to the inlet of said first heater.

* * * * *